US010737840B2

(12) United States Patent
Oates, II et al.

(10) Patent No.: US 10,737,840 B2
(45) Date of Patent: Aug. 11, 2020

(54) APPARATUS FOR ORAL DELIVERY OF FLUIDS AND SEMI-SOLID FOODS

(71) Applicant: PERFORMANCE PACKAGING OF NEVADA, LLC, Las Vegas, NV (US)

(72) Inventors: Robert Bradley Oates, II, San Diego, CA (US); Brian Paul Brock, Temple, AZ (US); Cory James Spivey, San Diego, CA (US); Dee L. Conger, Las Vegas, NV (US)

(73) Assignee: PERFORMANCE PACKAGING OF NEVADA, LLC, Las Vegas, NV (US)

( * ) Notice: Subject to any disclaimer, the term of this patent is extended or adjusted under 35 U.S.C. 154(b) by 398 days.

(21) Appl. No.: 14/044,698

(22) Filed: Oct. 2, 2013

(65) Prior Publication Data

US 2014/0097211 A1 Apr. 10, 2014

Related U.S. Application Data

(60) Provisional application No. 61/709,053, filed on Oct. 2, 2012, provisional application No. 61/802,141, filed (Continued)

(51) Int. Cl.

| | |
|---|---|
| ***B65D 25/42*** | (2006.01) |
| ***B65D 75/58*** | (2006.01) |
| ***B65D 25/48*** | (2006.01) |

(52) U.S. Cl.

CPC ..... *B65D 25/42* (2013.01); *B65D 25/48* (2013.01); *B65D 75/5883* (2013.01)

(58) Field of Classification Search

CPC ..... B65D 5/72; B65D 35/00; B65D 35/54; B65D 25/42; B67D 7/78; A61J 9/00;

(Continued)

(56) References Cited

U.S. PATENT DOCUMENTS 3,353,714 A 11/1967 Trecek
4,159,790 A * 7/1979 Bailey ..... 222/211

(Continued)

FOREIGN PATENT DOCUMENTS

| | | |
|---|---|---|
| JP | 11-100050 A | 4/1999 |
| WO | WO 2002/022073 | 3/2002 |
| WO | WO 2003/013419 | 2/2003 |

OTHER PUBLICATIONS

Notification Concerning Transmittal of International Preliminary Report on Patentability and Written Opinion of the International Searching Authority, dated Apr. 16, 2015.

*Primary Examiner* — Paul R Durand
*Assistant Examiner* — Andrew P Bainbridge
(74) *Attorney, Agent, or Firm* — Barnes & Thornburg LLP

(57) ABSTRACT

Devices, systems, and methods for orally delivering fluids and semi-solid foods to individuals for the promotion of health are disclosed. Various embodiments relate to a food delivery mouthpiece and related apparatuses and systems. Some embodiments of the food delivery mouthpiece include a spout and base. In some embodiments, the food delivery mouthpiece is configured for removable connection to a food container, such as, for example, to the straw of a flexible food pouch. In other embodiments, the food delivery mouthpiece is permanently coupled to a food pouch. Food delivery systems are disclosed, which include a food delivery mouthpiece, a food pouch, and fluids or semi-solid foods contained within the food pouches. A cap for the food delivery mouthpiece is also disclosed.

26 Claims, 7 Drawing Sheets

Related U.S. Application Data on Mar. 15, 2013, provisional application No. 61/814,163, filed on Apr. 19, 2013.

(58) Field of Classification Search

CPC .... A61J 9/001; A61J 9/08; A61J 9/006; A61J 11/005; A61J 11/008; A61J 11/0005

USPC ..... 222/95–96, 105–107, 464.2, 547, 222/566–570, 562–563; 383/80; 215/11.3–11.4, 11.6

See application file for complete search history.

(56) References Cited

U.S. PATENT DOCUMENTS 4,394,936 A * 7/1983 Shavit ..... 222/107
4,448,316 A * 5/1984 Hiroshige ..... B65D 77/283 215/229
4,669,124 A * 5/1987 Kimura ..... B65D 41/34 206/807
4,706,827 A * 11/1987 Cabernoch ..... A61J 9/001 215/11.1
4,718,778 A * 1/1988 Ichikawa ..... 383/100
5,137,183 A 8/1992 Mikulec
5,156,300 A * 10/1992 Spahni et al. ..... 222/105
5,307,955 A * 5/1994 Viegas ..... 222/107
5,520,304 A * 5/1996 Lin ..... A47G 19/2211 215/229
5,553,726 A * 9/1996 Park ..... A61J 11/002 215/11.1
5,573,127 A * 11/1996 Takahashi ..... B65D 47/0814 215/237
5,855,544 A * 1/1999 Buchanan ..... B29C 65/18 493/102
6,000,848 A * 12/1999 Massioui ..... 383/80
6,241,122 B1 * 6/2001 Araki et al. ..... 222/92
6,276,788 B1 * 8/2001 Hilton ..... 347/86
6,631,823 B2 * 10/2003 Stillinger ..... B65D 47/2025 220/714
6,675,482 B1 1/2004 Gilbert, Jr.
6,805,261 B1 * 10/2004 Laudenberg ..... 222/107
6,832,852 B2 * 12/2004 Wilkes ..... 383/120
6,981,614 B2 * 1/2006 Niggemyer ..... 222/107
7,097,065 B2 * 8/2006 Yoneoka ..... A47G 19/2266 220/203.06
7,374,046 B1 5/2008 O'Brien
7,392,916 B1 * 7/2008 Kuighadush ..... B65D 77/283 220/707
7,503,461 B1 * 3/2009 Hoffman ..... A61J 9/04 215/11.5
7,591,398 B2 * 9/2009 Pritikin et al. ..... 222/80
D613,120 S * 4/2010 Thompson ..... D7/510
7,762,439 B2 * 7/2010 Niggemyer et al. ..... 222/568
D629,250 S 12/2010 Finell
7,959,045 B2 * 6/2011 Kuge et al. ..... 222/495
D642,436 S * 8/2011 Schofield ..... D24/197
8,083,102 B2 * 12/2011 Murray ..... B65D 47/147 141/177
D672,210 S 12/2012 Rockwell
8,464,908 B1 * 6/2013 Tabor ..... B65D 51/1644 222/105
8,608,016 B2 * 12/2013 Chiu ..... A47G 19/2272 220/705
8,783,506 B2 * 7/2014 Lee ..... B65D 47/305 206/217
9,522,769 B2 * 12/2016 Itzek ..... B65D 47/247
9,539,180 B2 * 1/2017 Ridley ..... A61J 9/001
2003/0150890 A1 * 8/2003 Perricone ..... A61J 9/001 224/148.6
2005/0040128 A1 * 2/2005 Kong ..... A61J 9/001 215/11.3
2005/0040181 A1 * 2/2005 Kurosawa ..... B65D 75/5883 222/92
2005/0121405 A1 * 6/2005 Drajan ..... A47G 19/2272 215/11.4
2006/0201967 A1 * 9/2006 Romer ..... B65D 51/225 222/92
2007/0138121 A1 * 6/2007 Stribling ..... A47G 19/2272 215/11.4
2008/0067181 A1 * 3/2008 Kuighadush ..... B65D 77/283 220/723
2010/0147885 A1 6/2010 Braxton et al.
2010/0258589 A1 10/2010 Smith et al.
2011/0127232 A1 * 6/2011 Willows ..... B65D 47/088 215/354
2011/0240587 A1 * 10/2011 Cohn ..... A61J 9/005 215/11.3
2012/0284991 A1 * 11/2012 Kusz ..... A61J 1/1475 29/428
2013/0098861 A1 * 4/2013 Lair ..... A61J 9/00 215/11.1
2016/0206515 A1 * 7/2016 Snarr ..... A61J 9/006
2018/0214349 A1 * 8/2018 Mayer ..... A61J 9/001

* cited by examiner

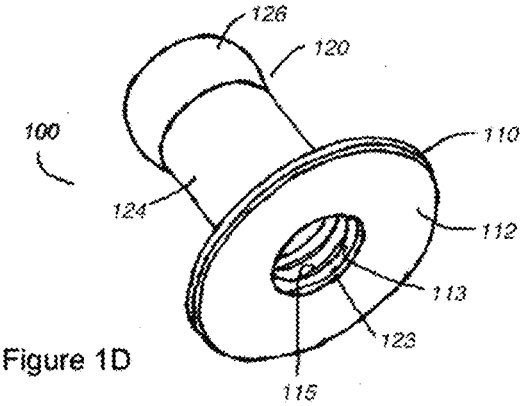
Figure 1D
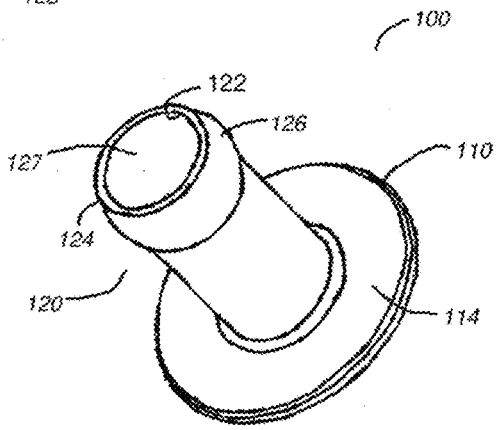
Figure 1E
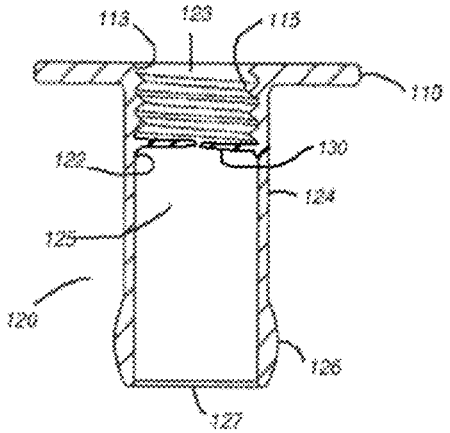
Figure 1F
Figure 1G
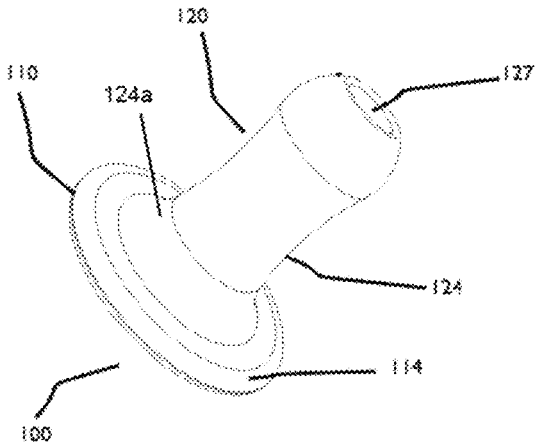
Figure 1H
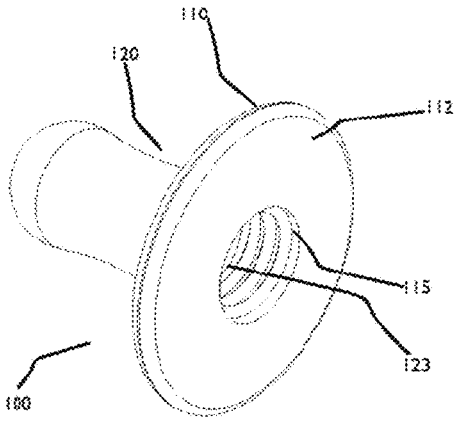

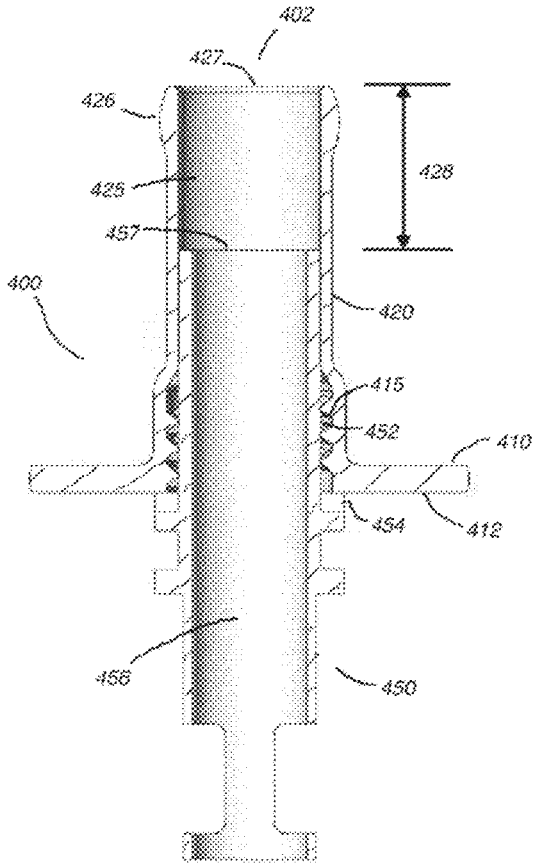
Figure 4A
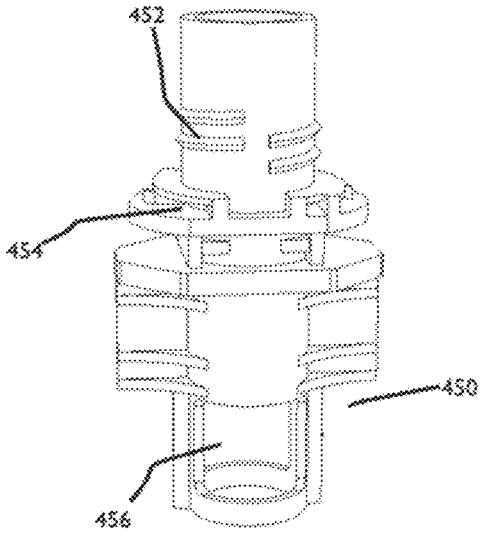
Figure 4B
*(prior art)*
Figure 4C
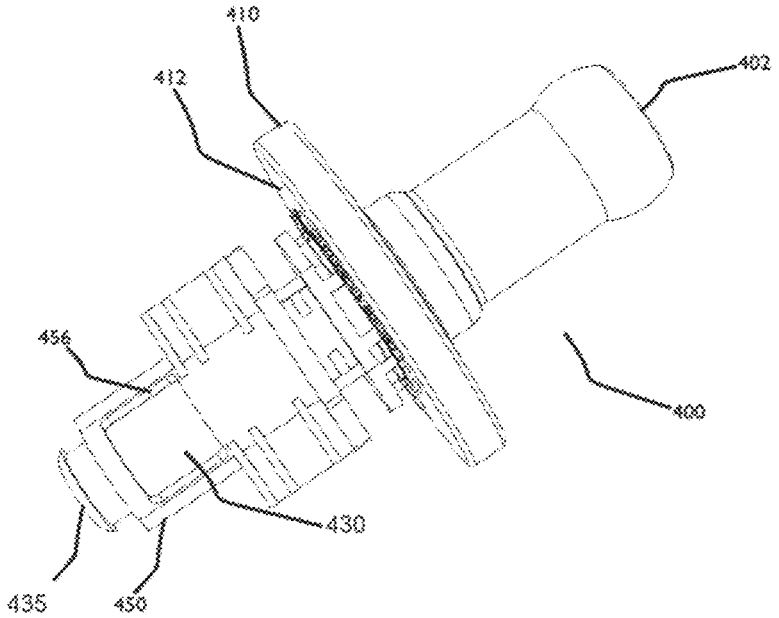

APPARATUS FOR ORAL DELIVERY OF FLUIDS AND SEMI-SOLID FOODS

CROSS-REFERENCE TO RELATED APPLICATIONS

This application claims the benefit of U.S. Provisional Application 61/709,053, filed Oct. 2, 2012, and entitled APPARATUS AND METHODS FOR ORAL ADMINISTRATION OF FLUIDS; U.S. Provisional Application 61/802,141, filed Mar. 15, 2013, and entitled APPARATUS AND METHODS FOR ORAL ADMINISTRATION OF FLUIDS; and U.S. Provisional Application 61/814,163, filed Apr. 19, 2013, and entitled APPARATUS FOR ORAL DELIVERY OF FLUIDS AND SEMI-SOLID FOODS; each of which is hereby incorporated by reference in its entirety.

BACKGROUND

Field of the Invention

Embodiments disclosed herein relate to apparatuses, systems, and methods for administering fluids and semi-solid food. More particularly, the present disclosure describes a food delivery mouthpiece and related apparatuses, systems, and methods for the oral delivery of fluids and semi-solid food to promote health and well-being and reduce pain and discomfort.

Description of the Related Art

Semi-solid foods are generally consumed by spoon, and young, infirmed, and disabled individuals are often unable to feed themselves in such a manner Feeding an infant, small child, or an infirmed or disabled individual can be a messy, time-consuming, and cumbersome task. A caregiver often requires at least two hands for the feeding process, for example, to hold a food container and a spoon, and/or to support the infant, child, or infirmed or disabled individual. Additionally, aligning the spoon with the individual's mouth can be a challenge and often results in the displacement of food about the face of the individual receiving the food and the surrounding area.

SUMMARY

A need exists for a food delivery system that allows for infants, small children, and infirmed or disabled individuals to independently feed. Moreover, a need exists for a food delivery system that helps infants and small children transition from bottle-feeding to eating semi-solid foods.

In recent years, disposable, squeezable pouches filled with semi-solid foods and liquids have entered the market. In general, each of these pouches has the same or similar design—a flexible foil pouch with a hard plastic mouthpiece and an exposed hard plastic straw having external threading. Such food pouches, in their current form, can lead to injury for infants, small children, and infirmed or disabled individuals. If the mouthpiece is placed too far into an individual's mouth, the individual's face may come into contact with a sharp foil edge of the pouch. Moreover, the hard plastic straw, exposed threads, and mouthpiece have a plurality of sharp edges that can irritate the gums, tongue, lips, and mouth of individuals, leading, in some cases, to bleeding, inflammation, or other mouth injuries. Such pouches can also lead to frustration for individuals trying to self-feed, because the hard plastic mouthpiece is awkwardly sized and shaped, which can make it difficult for the mouthpiece to stay in an individual's mouth.

Additionally, the hard plastic straws that are integrated into currently available food pouches extend only slightly into the food pouches. Such a configuration can limit food intake, for example, because food often remains stuck against the walls of a food pouch and/or in a distal/bottom portion of the pouch. Oftentimes, the negative pressure created by feeding alone is insufficient to expel such food from the food pouch, causing the food to remain inaccessible unless the individual user or a caregiver manually squeezes the food within the pouch upward. Many infants and infirmed or disabled individuals are unable to, or fail to recognize the need to, manually squeeze the food within the pouch.

Disclosed herein are embodiments of food delivery apparatuses and systems that may address one or more of the above-described needs. In some embodiments, a food delivery mouthpiece or system is provided, which is made, at least in part, from silicone, polypropylene, or other soft, flexible materials including rubber, polymers, or other material. In some embodiments, one or more of the edges are filleted and rounded to provide a safe and comfortable feeding experience. In some embodiments, all exposed, exterior edges are filleted and rounded. Additionally or alternatively, in some embodiments, the flexible mouthpiece is configured for placement over the hard plastic straw and threading of existing food pouch systems, rendering the existing food pouches safer for sensitive populations. In some embodiments, a flexible base or guard extends radially outward from the spout of the food delivery mouthpiece, protecting individuals from contact with the sharp foil edges of the food pouches. Moreover, in some embodiments, the spout of the food delivery mouthpiece is sized and shaped for ease of insertion into the mouth of an infant, young child, or infirmed or disabled individual. In some embodiments, the spout is elongated and optionally includes a bulbous feature on its proximal end configured to resemble, in part, the nipple of a baby bottle. In some embodiments, the design of the spout may facilitate an individual's transition from a bottle to solid foods.

While various examples disclosed herein are directed to infants and/or small children, this is merely done to simplify the description. It should be understood that the present embodiments are in no way limited to use within those exemplified populations. All apparatuses, systems, and methods disclosed herein may also be used to administer fluids and semi-solid foods to geriatric populations and to older children and/or adults who struggle with feeding themselves independently using conventional feeding utensils. Additionally, apparatuses, systems, and methods disclosed herein may also be used by individuals of all ages and abilities who wish to consume fluids and semi-solid foods from a pouch.

It should be understood that the apparatuses, systems, and methods of the present technology have several features, no single one of which is solely responsible for the desirable attributes described herein. Without limiting the scope, as expressed by the claims that follow, the more prominent features will be briefly disclosed here. After considering this discussion, one will understand how the features of the various embodiments provide several advantages over existing food delivery systems.

Various embodiments of the present technology may include, for example, a food delivery mouthpiece for connection to a food container. In some embodiments, the food delivery mouthpiece includes a base including a proximal face, a distal face, and a passage wall defining a passage extending through the base. The food delivery mouthpiece also can include, for example, a spout extending proximally from the proximal face, the spout comprising an inner wall defining a lumen and an outer wall and having an aperture on a proximal end. The base of various embodiments may be configured for attachment to a container of liquid or semi-solid food. When the base and container are attached, the liquid or semi-solid food can flow from the container, through the passage, through the lumen, and out the aperture. In some embodiments, at least a distal portion of the inner wall may have, for example, a circumference substantially equal to, and aligned with, a circumference of the passage wall. The inner wall of some embodiments may have a uniform circumference. The inner wall of some embodiments may include protrusions into the passage and/or lumen, which form valve features configured to influence the rate of flow of the fluid or semi-solid food within the food delivery mouthpiece. The passage wall may include but is not limited to threading, beaded protrusions, valves, or other internal features or molding for attaching the base to the food container. The outer wall of some embodiments can have, for example, a proximal portion that is bulbous-shaped. In some disclosed embodiments, the food delivery mouthpiece can be made, for example, of one or more of the following materials: rubber, one or more thermoplastics, and one or more polymers. In some embodiments, the lumen and aperture may be selectively sized and shaped to generate an age-appropriate rate of flow of the liquid or semi-solid food exiting from the aperture of the spout. In some embodiments the lumen and/or aperture can be sized to permit a given food to be able to pass through the opening into the mouth of the user without becoming obstructed. The spout and base of various embodiments can be integrally molded together, giving the food delivery mouthpiece a unitary body design.

An embodiment of a food delivery system is also disclosed, which may include, for example, a food delivery mouthpiece, such as the food delivery mouthpiece described above, and a squeezable pouch. In various embodiments, the squeezable pouch includes one or more collapsible walls and is filled at least partially with a liquid or semi-solid food. The food delivery mouthpiece of various embodiments additionally may include, for example, a straw integrally coupled to a proximal pouch end. The passage wall of the food delivery apparatus may engage with, and be disposed around, at least a portion of the integrally coupled straw. In some embodiments, the straw may extend substantially into an interior portion of the food pouch. For example, in some embodiments, the straw extends at least halfway into the interior portion of the pouch; in other embodiments, the straw extends at least three-fourths the length of the interior portion of the pouch. In some embodiments, the straw has an inlet and an aperture configured to receive liquid or semi-solid food from the interior portion of the pouch. In some such embodiments, the straw has a plurality of apertures positioned along a wall of the straw structure, for example, two, three, four, five, or more apertures. In some embodiments, the apertures may be in axial alignment along the length of the straw; in some embodiments, the apertures are substantially parallel to an front pouch wall and a back pouch wall.

BRIEF DESCRIPTION OF THE DRAWINGS

The above-mentioned features, as well as other features, aspects, and advantages of the present technology will now be described in connection with various embodiments of the invention, in reference to the accompanying drawings. The illustrated embodiments, however, are merely examples and are not intended to limit the invention.

FIG. 1D depicts a distally-facing perspective view of the embodiment illustrated in FIG. 1A.

FIG. 1E depicts a proximally-facing perspective view of the embodiment illustrated in FIG. 1A.

FIG. 1F depicts a cross-sectional view of another embodiment of a food delivery mouthpiece for connection to a food container.

FIG. 1G depicts a proximally-facing perspective view of another embodiment of a food delivery mouthpiece for connection to a food container.

FIG. 1H depicts a distally-facing perspective view of the embodiment illustrated in FIG. 1G.

FIG. 4A depicts a cross-sectional view of one embodiment of a food delivery mouthpiece attached to the straw of a food delivery pouch.

FIG. 4B depicts a perspective view of one embodiment of the straw of a food delivery pouch.

FIG. 4C depicts a perspective view of one embodiment of a food delivery mouthpiece attached to the straw of a food delivery pouch.

DETAILED DESCRIPTION OF CERTAIN EMBODIMENTS

Figure 1A:
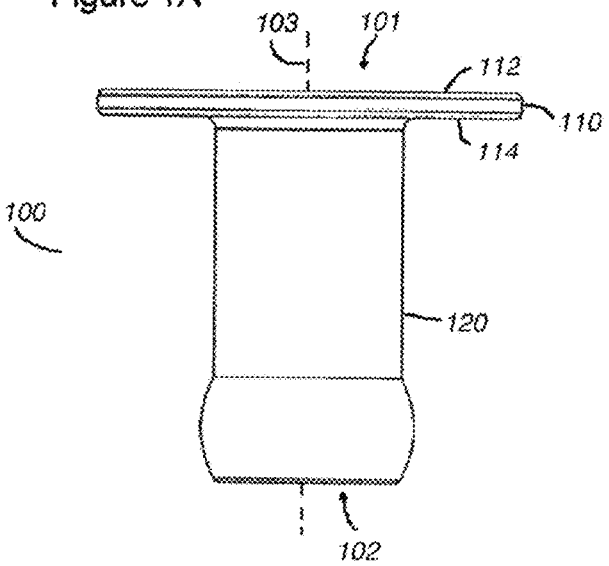
FIG. 1A depicts a side view of one embodiment of a food delivery mouthpiece for connection to a food container.

In the following detailed description, reference is made to the accompanying drawings, which form a part of the present disclosure. In the drawings, similar symbols typically identify similar components, unless context dictates otherwise. The illustrative embodiments described in the detailed description, drawings, and claims are not meant to be limiting. The detailed description is intended as a description of exemplary embodiments and is not intended to represent the only embodiments which may be practiced. The term "exemplary," as used herein, means "serving as an example, instance, or illustration," and should not necessarily be construed as preferred or advantageous over other embodiments. Other embodiments may be utilized, and other changes may be made, without departing from the spirit or scope of the subject matter presented here. It will be readily understood that the aspects of the present disclosure, as generally described herein and illustrated in the Figures, can be arranged, substituted, combined, and designed in a wide variety of different configurations, all of which are explicitly contemplated and form part of this disclosure.

As noted above, embodiments described herein generally relate to food delivery apparatuses, systems, and methods. In one or more embodiments, the apparatuses and systems can overcome one or more of the drawbacks, limitations, or deficiencies that exist with current food delivery systems and methods, without being limited thereto. For example, the apparatuses can be flexible, safe, soothing, free of hard or sharp edges, and configured to facilitate sucking. In some embodiments, the food delivery systems include food delivery mouthpieces directly and permanently coupled to a straw of a food delivery pouch. In other embodiments of the food delivery system, the food delivery mouthpiece is removably coupled to the straw of a food delivery pouch. The description herein provides examples of the apparatus, systems, kits, and methods according to various non-limiting embodiments.

Figure 1B:
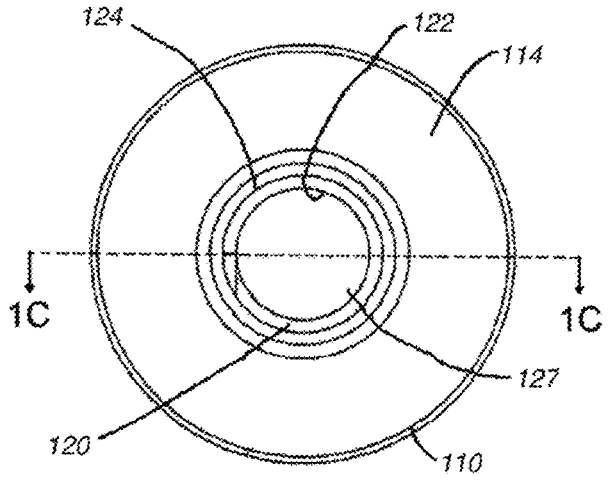
FIG. 1B depicts a top/proximal view of the embodiment illustrated in FIG. 1A.
Figure 1C:
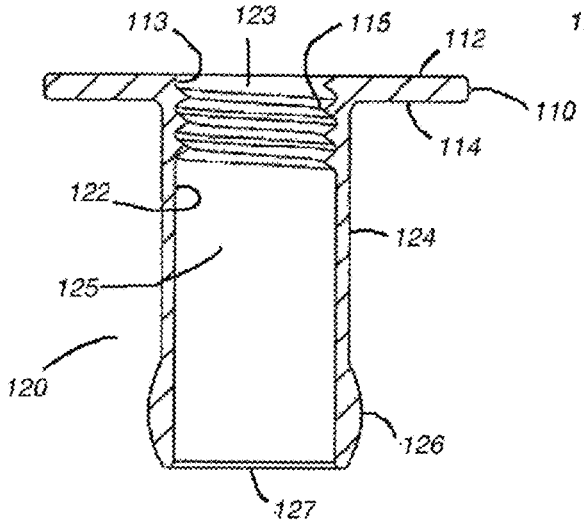
FIG. 1C depicts a cross-sectional view of the embodiment illustrated in FIG. 1A. The selected viewing angle of the cross-section is identified in FIG. 1B.

Various embodiments disclosed herein relate to apparatuses that can be used in connection with the consumption of foods, including semi-solid or liquid food. In some non-limiting aspects, the disclosed technology is directed to a food delivery mouthpiece which facilitates oral administration of fluids and/or semi-solid foods. FIGS. 1A-1E illustrate an example of a food delivery mouthpiece in accordance with one embodiment. FIG. 1A depicts a side view of the embodiment, while FIG. 1B provides a top/proximal view, FIG. 1C provides a cross-sectional view, and FIGS. 1D and 1E provide perspective views of the same embodiment. The food delivery mouthpiece 100 of FIGS. 1A-1E is configured to be removably coupled to a food delivery container, such as, for example, to a straw built into various embodiments of food delivery pouches (see, for example, the food delivery pouch 200 and the straw 220 in FIG. 2).

The mouthpiece 100 has a distal end 101 and a proximal end 102, as shown in FIG. 1A. The mouthpiece 100, as depicted, includes both a base 110 having a distal face 112 and a proximal face 114 and a spout 120 extending proximally from the proximal face 114. As used herein, the term "spout" refers to any projecting conduit configured for feeding. In several embodiments, the spout 120 is substantially tubular/cylindrical. It may, in some embodiments, include a taper. In some embodiments, the spout 120 includes a concave feature.

As illustrated in FIGS. 1B and 1C, the spout 120 of various embodiments of the food delivery mouthpiece 100 includes a tubular inner wall 122 and a tubular outer wall 124. As used herein, the term tubular inner wall 122 and tubular outer wall 124 may refer to an inner wall surface and outer wall surface, respectively, of a singular wall. The inner wall 122 defines an inner lumen 125 extending through the length of the spout 120. An aperture 127 is positioned at the proximal end 102 of the mouthpiece 100, and a passage wall 113, defining a passage 123 extending through the nipple base 110, is positioned at or near a distal end 101 of the mouthpiece 100. The lumen 125 provides a passageway through the spout 120 from the passage 123 to the aperture 127, such that liquid and/or semi-solid food can flow through the length of the mouthpiece 100.

In some embodiments, the lumen 125, defined by the inner wall 122, has a uniform circumference along the entire length of the spout 120. In some such embodiments, the spout 120 extends perpendicularly from the base 110, and the lumen 125 is axially aligned with the passage 123 and the aperture 127. For example, in some embodiments, the passage 123, the lumen 125, and the aperture 127 are all aligned along a central axis 103 extending through the center of the base 110. In other embodiments, the inner wall 122 and outer wall 124 of the spout 120 may be positioned at an angle greater or less than 90 degrees relative to the base 110 such that the passage 123 and the aperture 127 are not axially aligned in all directions relative to the central axis 103. In some embodiments, the inner wall 122 may be tapered such that the inner lumen 125 narrows or widens within the spout 120. In such embodiments, the outer wall 124 may or may not also be tapered. In some embodiments, the inner wall 122 may include non-linear portions, providing projections or depressions within the lumen 125. In some embodiments, the thickness of the spout 120 between the inner wall 122 and outer wall 124 is uniform in at least the proximal half of the spout 120. In some embodiments, the thickness of the spout 120 between the inner wall 122 and outer wall 124 is uniform along the entire, or substantially the entire, length and circumference of the spout 120.

The passage 123, lumen 125, and/or aperture 127 may vary in size and configuration between various embodiments. The passage 123 may be sized and configured to fit securely around a portion of a particular food container. For example, in one embodiment, the passage 123 is sized and configured to fit securely around a food container straw. In some embodiments, the passage 123 and at least a portion of the lumen 125 are specifically sized and configured to fit securely around a straw of a food delivery pouch, such as, for example, the straw 220 of the food delivery pouch 200 shown in FIG. 2. The size and configuration of the lumen 125 and passage 123 may be selected to achieve a desired securement strength between the straw 220 and the mouthpiece 100. Additionally or alternatively, the size and configuration of the lumen 125 and aperture 127 may be selected to achieve a desired average rate of flow based on a target age of the user and/or the viscosity of a particular fluid or semi-solid food. In some embodiments, the lumen 125 has a uniform or substantially uniform diameter while the aperture 127 has a narrower diameter to control flow of fluids and semi-solids through the aperture 127. In other embodiments, the diameter of the aperture 127 is wider than the diameter of the lumen 125. In some embodiments, the passage 123, the lumen 125, and the aperture 127 are axially aligned and equal or substantially equal in diameter.

In some embodiments, at least a portion of the outer wall 124 is concave, extending radially outward, giving the spout 120 a non-uniform shape and providing the spout 120 greater thickness at the outwardly extending portion. In some such embodiments, the outwardly extending portion of the outer wall 124 is located near a proximal end of the spout 120, providing the spout 120 with a proximally-located bulbous-shaped portion 126. In some embodiments, a bulbous shape is provided to facilitate proper placement of a recipient's lips on the spout 120 to achieve a comfortable fit. In some such embodiments, the bulbous portion is 0.1 inches in length, 1.0 inch in length, or any length therebetween. In other embodiments, the outer wall 124 may include other shapes or features (such as, for example, ribbing or depressions) to facilitate proper placement of the spout 120 within the mouth of a recipient.

In various embodiments, the base 110 is configured to act as a mouth guard. As shown in FIG. 1B, in some embodiments, the base 110 is cylindrical in shape with a circular distal face 112 and proximal face 114. In other embodiments, the distal face 112 and the proximal face 114 may be gumdrop-shaped or any other shape suitable for a spout mouth guard. The base 110 extends radially outward beyond the circumference of the spout 120. In some embodiments, the base 110 has a circumference at least greater than the opening of a young child's mouth. Such an embodiment may prevent a young child from placing the mouthpiece too far into his or her mouth, for example. In some embodiments, the base 110 is sized and shaped to prevent a choking hazard. In some embodiments, the base 110 may be any suitable size and/or shape.

The mouthpiece 100 may be made, for example, of a soft, semi-flexible material. In some embodiments, the mouthpiece 100 is made of rubber. In other embodiments, the mouthpiece 100 may be made of one or more thermoplastics or other polymer(s), for example. In several embodiments, the mouthpiece has no movable or removable parts. The mouthpiece 100 of some embodiments has an integral, unitary body design. The entire mouthpiece 100 may be made from one mold, for example. In other embodiments, the spout 120 and base 110 may be made separately and then fused, adhered, over-molded, or otherwise connected together to form a fixed connection between the two pieces. In various embodiments, the height and diameter dimensions are selected so as not to pose a choke hazard to young children. For example, in some embodiments, the maximum diameter of the base 110 (i.e., the diameter of the base 110 at its widest point) is at least 1.25 inches and the height of the mouthpiece 100 from the distal face 112 to the aperture 127 is at least 2.25 inches. In some such embodiments, the mouthpiece is formed of a material configured to have mechanical properties that also minimize the risk of choking. For example, in some embodiments, the base is formed to be substantially rigid. In some such embodiments, the material properties of the base allow it to withstand a minimum of 2 lbs. of force exerted upon the base 110 directionally toward the spout 120 with little or no deformation of the base or mouthpiece; in other embodiments, the base is configured to withstand at least 10 lbs. of a pulling force with little or no deformation; in other embodiments, it is configured to withstand a minimum force having a value anywhere therebetween. Additionally or alternatively, in some embodiments, the material properties of the mouthpiece allow it to withstand a minimum of 2 lbs. of torque, tension, pull, and/or compression without tearing or experiencing other structural failure; in other embodiments, the minimum torque, tension, pull, and/or compression the mouthpiece is configured to withstand is 10 lbs or any value between 2 lbs and 10 lbs.

The mouthpiece 100 of various embodiments includes a coupling mechanism or means for coupling the mouthpiece 100 to a food container. The mouthpiece 100 may couple to the food container via molded features, such as, for example, depressions, indents, holes, ridges, tapered walls, and/or projections, which are configured for engagement with complementary ridges, projections, depressions, indents, appropriately sized tapered walls, and/or holes. In some embodiments, one or more molded features are formed or positioned within or upon the passage wall 113 and/or a distal portion of the inner wall 122 of the mouthpiece 100. The one or more molded features of such an embodiment are configured for coupling to one or more complementary molded features positioned on a portion of a food container. As shown in FIG. 1C, the coupling means may include helical threading 115 spanning the entirety, or a portion, of one or both of the passage wall 113 and inner wall 122. This threading 115 is configured for screwed engagement with thread(s) positioned on a straw or other open, mouth-like portion of a food container.

In some embodiments, one or more molded features of various dimensions and frangibility are positioned within the passage wall 113 and act as valves to further control delivery from the passage 123 through the lumen 125 and out of the aperture 127. As used herein, a valve refers to any physical feature, which slows, restricts, blocks, regulates, or controls flow of fluids and/or semi-solids through the spout 120. In some embodiments, for example, the embodiment depicted in FIG. 1F, a valve 130 is positioned along the inner wall 122, for example, proximal to the threading 115. The valve 130 may be formed of one or more projections or protrusions of the inner wall 122 into the lumen 125. The valve 130 of some embodiments is formed of one or more flaps or cusps, which are fixedly attached to, or integrally molded with, the inner wall 122 or passage wall 113. In some embodiments, the valve 130 fully occludes, substantially occludes, or partially occludes a portion of the lumen 125 when in a resting state. In some embodiments, the valve is molded to achieve desired mechanical properties, such as a desired elasticity. In some embodiments, the valve 130 has a minimum opening pressure between 5 kPa and 50 kPa. In some embodiments, the valve 130 has a minimum opening pressure of 10 kPa, 20 kPa, or any value, range, or subrange therebetween. In one embodiment, the valve 130 has a minimum opening pressure of 12 kPa.

In some embodiments, for example, the embodiment of FIGS. 1F and 1G, a portion of the outer wall 124 located at or near the distal end of the spout 120 extends radially outward, providing the outer wall 124 of the spout 120 with greater thickness at or near the distal end of the spout 120. The location of this outwardly extending portion 124*a* may correspond to a location of threading 115 on the inner wall 122. This outwardly extending portion 124*a*, in some embodiments, provides for increased stiffness in this portion of the outer wall 124, which may aid in securement of the mouthpiece 100 onto a straw or other open, mouth-like portion of a food container. Additionally or alternatively, in some embodiments, at least the portion of the mouthpiece 100 having threading 115 is molded out of a relatively rigid polymer such as a thermoplastic to increase securement to a food pouch.

In various embodiments of the mouthpiece 100, one or more molded features are filleted and free of sharp edges. Rounded concave features may be included at various locations along the mouthpiece 100. For example, the mouthpiece 100 of FIGS. 1G-1H includes a tubular spout 120 having a non-uniform width. The depicted outer wall 124 narrows near the middle of the spout 120 and extends outwardly near the distal end and the proximal end. In some embodiments, the lumen 125 of the spout 120 takes a non-uniform shape. For example, in some embodiments, contours of the inner wall 122 substantially match the contours of the outer wall 124.

Figure 2:
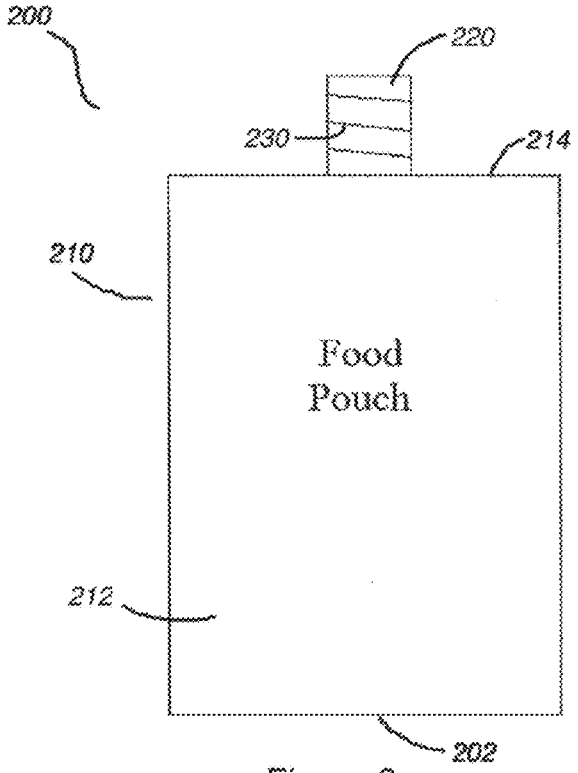
Figure 2 (prior art)
FIG. 2 depicts a side view of an example of a food delivery pouch.

FIG. 2 provides a schematic of one embodiment of a food container, in particular, a food delivery pouch 200 to which the mouthpiece 100 may couple. The food delivery pouch 200 of FIG. 2, or a container similar to it, is currently available on the market. The food delivery pouch 200 of some embodiments includes a pouch portion 210 having a plurality of flexible walls, including at least one collapsible wall. In some embodiments, a collapsible wall (not shown) is positioned at or near a distal end 202 of the food delivery pouch 200 and adjoins a front facing wall 212 with a back facing wall (not shown). The pouch portion 210 may contain fluid or a semi-solid food in an interior portion of the pouch portion 210. In some embodiments, a top/proximal portion of the food delivery pouch 200 includes a straw 220 having threading 230 disposed on the outer surface of the straw 220. The pouch portion 210 of various embodiments is configured to be squeezed; upon squeezing, the collapsible wall may at least partially collapse, and at least a portion of the fluid or semi-solid food within the pouch 210 may be expelled through the straw 220. In several embodiments, the straw 220 and threading 230 are made of a hard plastic, which may irritate and injure sensitive gums when placed within a recipient's mouth.

Figure 3:
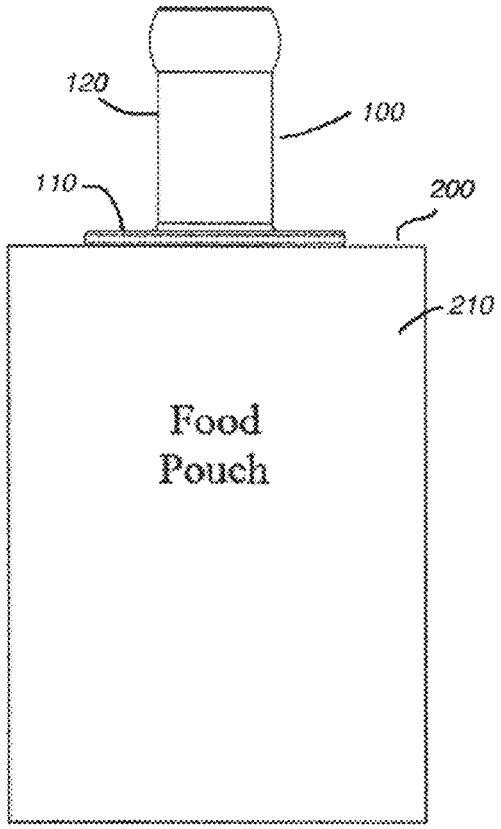
FIG. 3 depicts a side view of one embodiment of a food delivery system having a food delivery pouch and a food delivery mouthpiece.

As shown in FIG. 3, in various embodiments of the disclosed technology, a food delivery mouthpiece, such as, for example, the mouthpiece 100 of FIGS. 1A-1F, is configured for placement on a food container, such as, for example, the straw 220 of the food delivery pouch 200 of FIG. 2. The coupling means positioned within or upon the passage wall 113 and/or the inner wall 122 of the mouthpiece 100 may securely engage the straw 220 of the food delivery pouch 200. In some embodiments, the threading 115 of the passage wall 113 and/or the inner wall 122 engages with the outer threading 230 of the straw 220, and the mouthpiece 100 is positioned over and around the straw 220. In some embodiments, the mouthpiece 100 completely covers the portion of the straw 220 protruding externally from the pouch 210, such that no portion of the straw 220 is exposed. In other embodiments, the mouthpiece 100 only engages with an upper/proximal portion of the straw 220, leaving a distal portion of the straw 220 exposed. In such embodiments, for example, the base 110 functions as a mouth guard, substantially reducing the likelihood that a recipient's mouth will come into contact with the exposed portion of the straw 220 when the spout 120 is placed into the recipient's mouth. In various embodiments, the base 110 also helps to guard the recipient's mouth from contact with a sharp edge 214 of the food delivery pouch 200.

In some embodiments of the present technology, the mouthpiece 100 and food delivery pouch 200 form a system, which additionally includes a fluid or semi-solid food contained within the pouch portion 210 of the food delivery pouch 200. In various embodiments, the components of the system are configured such that upon squeezing the pouch portion 210 of the food delivery pouch 200, food is pushed out of the pouch portion 210, travels through the passage 123 and the lumen 125, and is ultimately expelled from the aperture 127.

FIG. 4A depicts a cross-section of one embodiment of a food delivery mouthpiece 400 in accordance with the invention attached to a prior art straw 450 of a currently available food delivery pouch. In some embodiments, the mouthpiece 400 is configured to be pushed or twisted onto at least a portion of the straw 450 extending from a proximal end of a food delivery pouch. The mouthpiece 400 of some embodiments is configured to snuggly engage the straw 450 such that an inner wall of the mouthpiece 400 at least partially abuts an outer wall of the straw 450. In various embodiments, the mouthpiece 400 is secured to the straw 450 via a press fit, snap fit, interference fit, and/or through a screwed engagement. In some embodiments, the mouthpiece 400 is screwed into place on the straw 450 within a 0 to 360 degree rotation. The mouthpiece 400 may include a variety of friction mechanisms, for example, internal threads or depressions, indents, holes, ridges, tapered walls, and/or projections, distending from a passage wall into a passage that extends through the center of the base 410. In some embodiments, threads 415 or other engagement features disposed on an inner wall or passage wall of the mouthpiece 400 complementarily engage with threads 452 or other engagement features disposed on an outer wall of the straw 450. In various embodiments, attaching the mouthpiece 400 to the straw 450 axially aligns an inner channel 456 of the straw 450 with the lumen 425 of the spout 420. The mouthpiece 400 of some embodiments is configured to be pushed, slid, or twisted onto the straw until the distal face 412 of the base 410 makes contact with or comes to rest slightly above a hard external protrusion 454 of the straw 450. In some such embodiments, the mouthpiece 400 in the attached configuration has a proximal portion 428, which extends beyond a proximal end 457 of the straw 450. This proximal portion 428 of the mouthpiece 400 may include a bulbous portion 426, a tapered section, or any other features configured for facilitating a comfortable placement of an individual's lips onto the spout 420. In some embodiments, the proximal portion 428 of the mouthpiece 400 extends 0.01 inches to 5 inches beyond the proximal end 457 of the straw 450, or any individual value therebetween. In some embodiments, the proximal portion 428 of the mouthpiece 400 is 0.5 inches in length; in other embodiments, the proximal portion is 0.75 inches in length; in still other embodiments, the proximal portion 428 is any length therebetween. In some such embodiments, the proximal portion 428 is deformable.

An alternative straw 450 shown in the prior art is provided in FIG. 4B. Another embodiment of a food delivery system, which includes one embodiment of a food delivery mouthpiece 400 in accordance with the invention disclosed herein and the prior art straw 450 of FIG. 4B, is provided in FIG. 4C. As depicted in FIG. 4C, the mouthpiece 400 of some embodiments includes a distal face 412 configured to make contact with a hard external protrusion 454 of the straw 450. This hard external protrusion 454 includes undercut sections that may be utilized to secure the base 410 of a mouthpiece 400 to increase securement of the mouthpiece 400 to the straw 450. In other embodiments, the distal face 412 of the base 410 may have an appropriate shape and size intended to fit partially within, and secure to, the undercut sections of the hard external protrusion 454.

In some embodiments of the mouthpiece, for example, the mouthpiece 400 of FIG. 4C, the mouthpiece includes an inner straw extension 430 extending distally from the distal face 412 of the mouthpiece 400. The inner straw extension 430 of various embodiments defines an inner straw lumen, which is in fluid communication with the lumen 425 of the spout 420. In various embodiments, the inner straw extension 430 is an integrally molded component of the mouthpiece 400. In some embodiments, the inner straw extension 430 is designed and configured to extend distally within an inner channel 456 of the straw 450. In some embodiments, the inner straw extension 430 is configured to extend beyond the distal end of the straw 450. The inner straw extension 430 may include an anchor 435. In some embodiments, the anchor 435 is a radially extending distal portion of the inner straw extension 430, which extends radially beyond an inner perimeter of the straw 450, ensuring that the inner straw extension 430 remains secured within the straw 450. In such embodiments, the inner straw lumen extends through the anchor 435 to a distal inlet. In some embodiments, the food delivery system, including the straw 450 and the mouthpiece 400 having an inner straw extension 430, is formed using 3-D printing or other suitable molding or fabrication techniques.

In some embodiments, the inner straw extension 430 may have a plurality of holes or openings to facilitate sucking food or fluids through a food pouch. The holes or other openings may be in one or more longitudinal rows, one or more rings around the circumference of the inner straw extension 430, or positioned in a scattered, offset, and/or random arrangement. An inherent limitation of available food pouches and prior art straw systems is the ability for an individual, especially young or infirmed, to extract semi-solid foods completely from a pouch. In some situations where improving a straw 450 is not practical, the food delivery system 400 may overcome this limitation by allowing the inner straw extension 430, which may be permanently coupled to the food delivery system, to act as an extended straw 450. Alternatively, the inner straw extension 430 may have a uniform diameter that complements the diameter of the inner channel 456 of the straw 450.

Figure 5A:
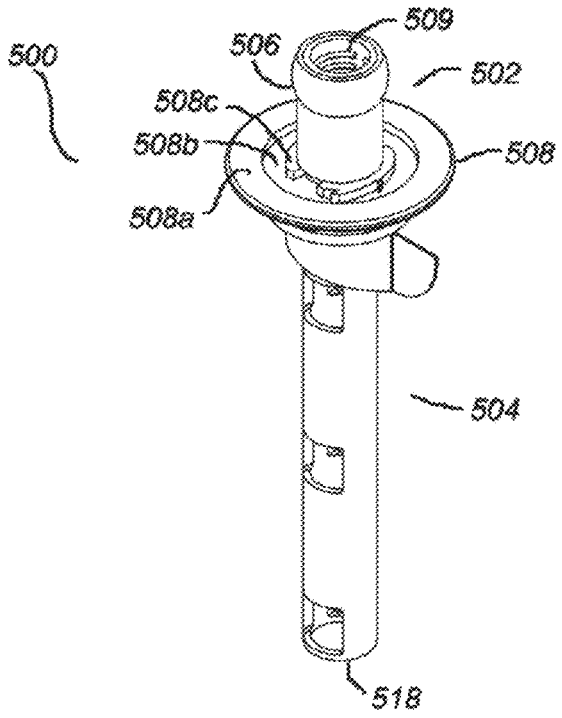
FIG. 5A depicts a perspective view of one embodiment of a food delivery system that includes a food delivery mouthpiece having a dispensing straw structure, which can be integrated with a food pouch.
Figure 5C:
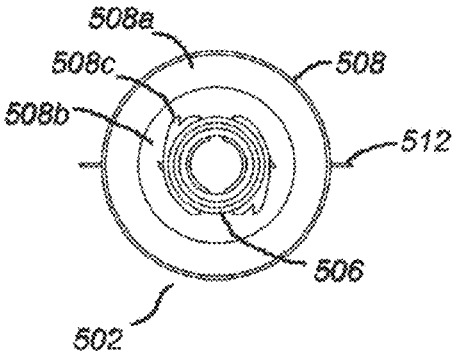
FIG. 5C depicts a top/proximal view of the embodiment illustrated in FIG. 5A.
Figure 5B:
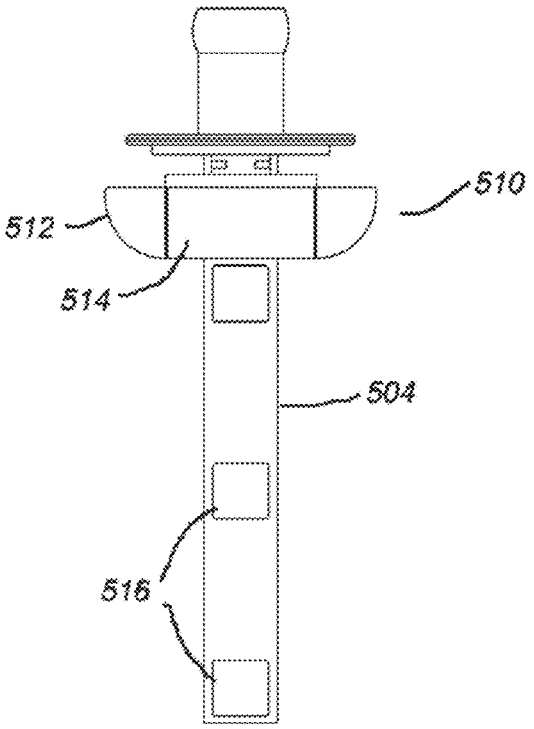
FIG. 5B depicts a side view of the embodiment illustrated in FIG. 5A.
Figure 6A:
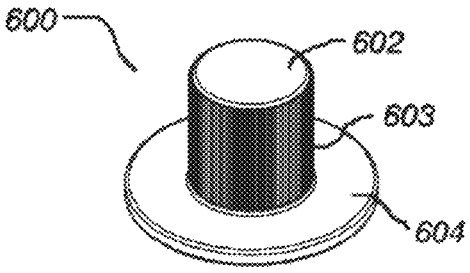
FIG. 6A depicts a perspective view of one embodiment of a cap system that can be used, for example, with the food delivery systems described herein.
Figure 6C:
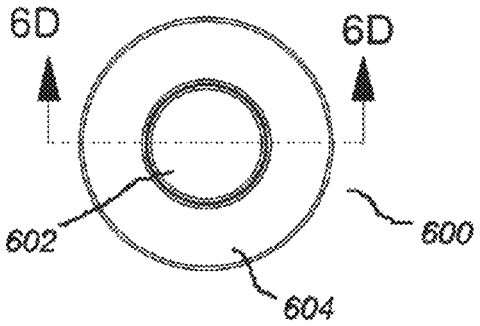
FIG. 6C depicts a top/proximal view of the embodiment illustrated in FIG. 6A.
Figure 6B:
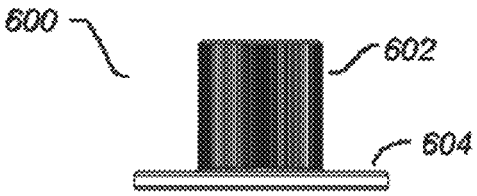
FIG. 6B depicts a side view of the embodiment illustrated in FIG. 6A.
Figure 6D:
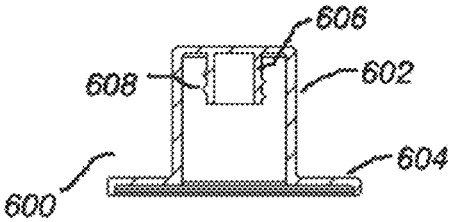
FIG. 6D depicts a cross-sectional view of the embodiment illustrated in FIG. 6A.

FIGS. 5A-5C depict a non-limiting example according to some embodiments of a food delivery system 500 for use with a food delivery pouch. The food delivery system 500 of some embodiments includes a mouthpiece 502 permanently coupled to a straw having a dispensing straw structure 504 extending distally therefrom. As shown in FIGS. 5A and 5B, in some embodiments of the disclosed technology, the mouthpiece 502 is integrated with the straw and dispensing straw structure 504 as a single structure that can be attached to or integrated with a food pouch (not shown). For example, the food delivery system 500 can be sealed or otherwise attached to an unfilled pouch (prior to filling with food), or it can be added to a food-filled pouch, which then can be sealed prior to shipping, etc. The mouthpiece 502 can have any of the features described elsewhere herein. The spout 506 can be made of any of the materials described herein and can be sized and configured as described above. The base 508 can have one or more of the characteristics and/or attributes described herein for such bases. In some aspects, the base 508 can provide protection to the mouth of a user consuming a food or beverage from the food delivery pouch. For example, as described above, the base 508 can extend radially outward to a diameter that substantially limits a user's likelihood of having the user's face come into contact with a sharp edge on the top portion of the food delivery pouch. In addition, as depicted in FIG. 5A, in some embodiments, the base 508 may include an elevated portion 508*a* and a recessed portion 508*b*, wherein the elevated portion 508*a* is elevated in the proximal direction in relation to the recessed portion 508*b*. In some such embodiments, the differences in elevation are provided so that any edges 508*c* that may exist at the junction of the spout 506 with the base 508 are disposed within the recessed portion 508*b* so as to limit a user's oral contact with the edges 508*c*. In some embodiments, the edges 508*c* may exist to help break a tamper-proof seal (not shown) on a cap or lid, such as, for example, the cap 600 shown in FIG. 6A. In some embodiments, the edges 508*c* may be the remnants of a tamper-proof seal that remain after the seal is broken. In some embodiments in which the straw structure 504 and the mouthpiece 502 form a single, integral unit, the base 508 and the straw structure 504 are formed of a relatively inflexible plastic material, and the spout 506 is formed of silicone, latex, rubber, or other suitable thermoplastic or other flexible polymer. In other embodiments, the spout 506 and base 508 are both formed of a flexible material, such as one of the flexible materials previously mentioned. In some embodiments, every edge and/or corner of the mouthpiece is rounded or filleted to promote safety and comfort and limit the likelihood of mouth irritation.

As shown in FIG. 5A, and as described in more detail below, in some embodiments, the mouthpiece 500 includes a cap engagement feature disposed on an inner wall of the spout 502 for coupling to a cap or lid. In some embodiments, the cap engagement feature includes internal threading 509, protrusions, and/or indentations disposed within the lumen of the spout 502. Such placement of the cap engagement feature is designed to limit a consuming user's oral contact with the edges of the threading 509. Internal threading, for coupling to a cap or lid, may be present in any mouthpiece embodiment, such as, for example, any of the embodiments described above. The internal threading may be present in some embodiments of the removable mouthpieces as well as in some embodiments of the permanently straw-coupled mouthpieces.

The food delivery system 500 further includes a food pouch attachment portion 510, as shown in FIG. 5B. In some embodiments, the attachment portion 510 is designed to contact at least a portion of the food pouch (not shown) so that the food delivery system 500 can be securely attached to the food pouch in a filled or unfilled state. Any suitable configuration that permits the mouthpiece 502 to be secured to the pouch can be utilized. The mouthpiece 502 and the attachment portion 510 can be formed of a unitary structure or they can comprise two or more components that are attached to form a complete structure. The attachment portion 510 can include, without limitation, one or more of a central portion 514 that includes an inner cavity through which food can pass and one or more attachment wings 512. While the wings 512 are shown as "wing" like structures, any suitable geometry or configuration can be used which allows for adhesion or attachment of the pouch to the attachment portion 510. The particularly shown wings 512 are relatively planar on two faces and are not designed with an inner cavity. The attachment portion 510 can be attached to a food pouch through any suitable mechanism, for example, via an adhesive such a glue, paste, tape, or other adhesive material; via one or more mechanical features such as clips or staples; via ultrasonic welding; and/or via use of temperature-responsive materials, such as a heat-shrinking approach, etc.

The food delivery system 500 as depicted includes an optional dispensing straw structure 504 that includes one or more food apertures 516. In some embodiments, the apertures 516 are positioned so that upon applying a force, such as a sucking or squeezing force, food or fluid within the pouch enters into one or more of the apertures 516 and is dispensed up and out of the mouthpiece 502 of the food delivery system 500. It should be understood that the number, size, shape, spacing, etc. of the apertures 516 can be modified. In some embodiments, zero, one, two, three, or more apertures 516 are present. In some aspects where such a dispensing straw structure 504 is utilized, a distal inlet 518 can be included on the bottom face of the straw structure 504, for example, as in common plastic straws used to consume drinks. The apertures 516 can be offset longitudinally and/or latitudinally (not shown). In some embodiments, the straw structure 504 is configured to extend along a substantial length of a food delivery pouch. In other embodiments, the straw structure 504 may be shorter and may extend, for example, ¾ths of the length, ½ of the length, ⅕th of the length of the food delivery pouch, or any length therebetween. In some embodiments, no straw structure 504 is present within the complete food delivery pouch system. The straw structure 504 and apertures 516 are designed to improve the ease with which fluid or semi-solid food is extracted from a sucking or vacuum force placed on the mouthpiece 502. In some embodiments, as the front facing wall and back facing wall 212 of FIG. 2 collapse from the negative pressure created from feeding from the mouthpiece 502 or by squeezing, apertures 516 come into contact with the walls 212 throughout straw structure 504 and food stuck to the walls 212 may be able to be sucked up through the apertures 516 into the straw. In some embodiments, the straw structure 504 is flexible.

FIG. 5C shows one example of a top view of the food delivery system 500 with a mouth piece 502 having a spout 506 and a base 508, as well as edges 508*c* at the junction of the spout 506 and the base 508, wherein the edges 508*c* are tucked into a recessed portion 508*b* of the base 508 and surrounded by an elevated portion 508*a*, so as to restrict contact between a user's mouth and the edges 508*c*. The outer ends of the wings 512 are also shown.

FIGS. 6A-6D depict various views of one embodiment of a cap system 600 that can be used, for example, with the food delivery pouch systems or food delivery mouthpiece systems described herein. The cap system 600 includes a spout covering 602 and a base covering 604, configured for placement over a mouthpiece (e.g., mouthpiece 100 of FIG. 1 or mouthpiece 502 of FIG. 5), such that when the cap system 600 is placed on the mouthpiece, the cap system 600 covers some or all of the outer surfaces of the mouthpiece. In some embodiments, every outer an/or exposed surface of the mouthpiece is covered by the cap system 600 in order to help keep the mouthpiece clean and limit exposure to dirt and germs. In some embodiments, the outer spout covering 602 includes ribs, threads, or other features configured to create a frictional surface to facilitate grasping and turning of the cap system 600 by an individual.

In various embodiments, the cap system 600 also includes a lumen securement portion 606. The lumen securement portion 606, as depicted, inserts at least partially into the inner lumen of a mouthpiece spout and can help secure the cap to the mouthpiece and/or can provide improved sanitation or cleanliness by at least partially "plugging" the opening. The depicted lumen securement portion 606 includes threading 608 configured to mate with corresponding threading on the inside of the mouthpiece spout, such as, for example, the threading 509 described with reference to FIG. 5A. Advantageously, by placing the engagement threading 608 on a lumen securement portion 606 configured for placement within the lumen of a mouthpiece, the cap system 600 can securely couple to the mouthpiece via a screwed engagement without the need for any securement features on an exposed surface of the mouthpiece. Such a configuration limits contact between the mouth of a user and any potentially irritating threading or edges. Such threading is optional. In other embodiments, other engagement features are provided on the lumen securement portion 606 of the cap system 600 and on an inner wall surrounding the lumen of the mouthpiece. For example, in some embodiments, complementary and/or interlocking indentations and protrusions may be present in the lumen and on the lumen securement portion 606 such that the cap system 600 securely couples to the mouthpiece via a press fit, snap fit, or interference fit. In other embodiments, the lumen securement portion 606 couples to complementary and/or interlocking indentations or protrusions in a straw, such as, for example, indentations or protrusions forming a portion of the straw 450 of FIG. 4A or 4C. In some such embodiments, the lumen securement portion 606 couples to indentations or protrusions near a proximal end of the internal channel 456 of the straw 450. In some embodiments, the lumen securement portion 606 may extend distally through a straw 450 similar to the inner straw extension 430 shown in FIG. 4C and may include a semi-flexible anchor extending beyond the distal end of the straw. Additionally or alternatively, in some embodiments, the cap system 600 includes a strap (not shown), which fixedly attaches the cap system 600 to the mouthpiece.

Figure 7:
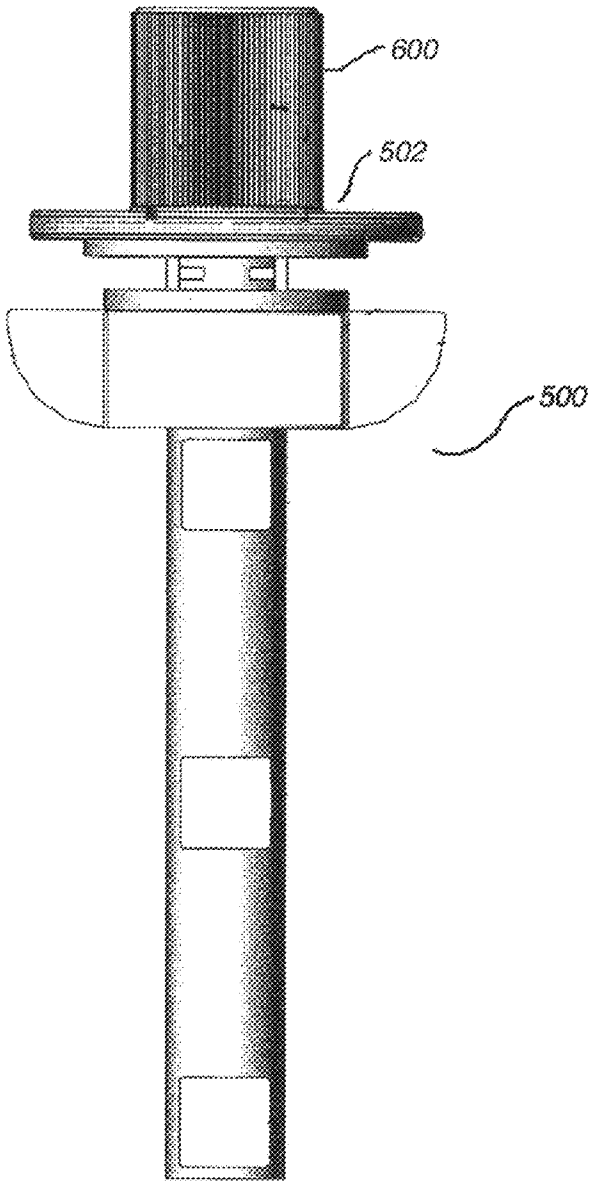
FIG. 7 depicts a side view of one embodiment of a food delivery system that includes an integrated food delivery straw and mouthpiece and a cap system.

FIG. 7 depicts one non-limiting embodiment of a food delivery system (e.g., the food delivery system 500 of FIGS. 5A-5C) with a cap system (e.g., the cap system 600 of FIGS. 6A-6D) with the cap system 600 attached to the mouthpiece 502 of the food delivery system 500.

A method of feeding an individual is also disclosed. In some embodiments, an individual, such as an infant, young child, or infirmed or disabled individual is provided a flexible and disposable food pouch. In some embodiments, the food pouch is coupled directly and fixedly to a food delivery mouthpiece, shown, for example, in FIGS. 5A-5C. In other embodiments, a caregiver or the individual to receive the food must attach a removable mouthpiece, such as shown, for example, in FIGS. 1A-1H. As described in more detail above, the removable mouthpiece may be securely attachable via a press fit, snap fit, interference fit, or through a screwed engagement. In some embodiments, a cap system, such as the cap system of FIG. 7 is removed. A spout shown in the various embodiments of the mouthpiece can then be placed into an individual's mouth and the pouch squeezed in order to direct the food from the food pouch, through a passage extending through a base of the mouthpiece, through a lumen extending through a spout of the mouthpiece, and out an aperture at a proximal end of the mouthpiece. In some embodiments, the food within the food pouch is expelled from the food pouch into the mouthpiece by way of a straw. In some embodiments, the food enters the straw through one or more apertures and/or inlets. In some embodiments of the method, an infant, young child, or infirmed or disabled individual feeds his- or her-self independently of a caregiver.

Various embodiments of the mouthpiece have been described herein as attaching, removably or permanently, to a food delivery pouch. However, such embodiments are not intended to limit or restrict the mouthpiece to use only with a food pouch. The various embodiments disclosed herein may be configured to removably or permanently couple to a variety of products, such as, for example, flexible pouches, non-flexible pouches, bottles, cans, cups, and other food storage containers, and/or medical device attachments such as nebulizers, inhalers, and other spacers. Various embodiments of the removable food delivery mouthpiece are reusable and intended for repeat use. The mouthpiece of such embodiments is configured to be attached to, and removed from, a food delivery pouch or other food storage container. In some embodiments, the internal passages and lumens of the mouthpiece are surrounded by a non-stick or somewhat non-stick surface, facilitating the cleaning of the mouthpiece between uses. In some embodiments, the removable mouthpiece includes a universal configuration allowing it to snuggly but removably couple to every, or nearly every, or at least many, food delivery pouch(es) on the market. The permanently affixed mouthpiece of various embodiments is disposable and intended to be discarded, along with the food delivery pouch to which it is coupled, after a single use.

The foregoing description details certain embodiments of the systems, devices, and methods disclosed herein. It will be appreciated, however, that no matter how detailed the foregoing appears in text, the devices and methods can be practiced in many ways. As is also stated above, it should be noted that the use of particular terminology when describing certain features or aspects of the invention should not be taken to imply that the terminology is being re-defined herein to be restricted to including any specific characteristics of the features or aspects of the technology with which that terminology is associated. The scope of the disclosure should therefore be construed in accordance with the appended claims and any equivalents thereof.

It will be appreciated by those skilled in the art that various modifications and changes may be made without departing from the scope of the described technology. Such modifications and changes are intended to fall within the scope of the embodiments, as defined by the appended claims. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims are generally intended as "open" terms (e.g., the term "including" should be interpreted as "including but not limited to," the terms "comprising" and "having" should, respectively, be interpreted as "comprising at least" and "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an." In general, "a" and/or "an" should be interpreted to mean "at least one" or "one or more"; the same holds true for the use of definite articles used to introduce claim recitations. Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Although the technology has been described with reference to embodiments and examples, it should be understood that numerous and various modifications can be made without departing from the spirit of the invention. Accordingly, the technology is limited only by the following claims.

What is claimed is:

1. A unitary food delivery mouthpiece for connection to a food container, comprising:

a base comprising a proximal face, a distal face, and a passage wall defining a passage extending through the base; and a spout extending proximally from and unitarily coupled to the proximal face and having an aperture on a proximal end, the spout comprising an outer wall and an inner wall integral with the outer wall, the inner wall defining a lumen and wherein a proximal portion of the outer wall is bulbous-shaped and made of a soft semi-flexible material to resemble the shape and feel of a nipple;

wherein the passage, the lumen, and the aperture are substantially equal in diameter and are connected such that a liquid or semi-solid food can flow from an attached container, through the passage, through the lumen, and out the aperture;

the mouthpiece being configured for placement over a hard plastic straw secured to and extending outwardly from the food container such that at least a portion of the inner wall of the mouthpiece abuts an outer wall of the straw outside of the food container and the mouthpiece being configured for being removably connected to the straw.

2. The food delivery mouthpiece of claim 1, wherein the passage, the lumen, and the aperture are axially aligned.

3. The food delivery mouthpiece of claim 1, wherein the inner wall has a substantially uniform circumference.

4. The food delivery mouthpiece of claim 1, wherein the food delivery apparatus is made of one or more materials selected from a group consisting of: rubber, one or more thermoplastics, and one or more polymers.

5. The food delivery mouthpiece of claim 1, wherein all external edges of the food delivery apparatus are rounded or filleted.

6. The food delivery mouthpiece of claim 1, wherein a valve is disposed within the lumen and the valve has a minimum opening pressure of 12 kPa.

7. The food delivery mouthpiece of claim 1, wherein the spout and the base are integrally molded or formed together.

8. The food delivery mouthpiece of claim 1, wherein the base is sized to prevent a choking hazard and has a diameter of at least 1.25 inches and the mouthpiece has a height of at least 2.25 inches.

9. The food delivery mouthpiece of claim 8, wherein the base is configured to withstand at least a minimum of 2 lbs of force exerted directionally toward the spout without deformation of the food delivery mouthpiece.

10. The food delivery mouthpiece of claim 1, configured to couple to the straw such that the passage wall is disposed around an outer surface of the straw, wherein upon coupling, a proximal portion of the spout extends 0.01 inches to 5 inches beyond a proximal end of the straw.

11. A food delivery mouthpiece system, comprising:

the food delivery mouthpiece of claim 1; and a protective cap comprising a spout covering portion, a base covering portion, and a lumen securement portion, wherein the lumen securement portion of the protective cap is configured to be inserted at least partially into the lumen of the spout and to engage a cap engagement feature.

12. The food delivery mouthpiece system of claim 11, wherein the cap engagement feature comprises complementary and/or interlocking indentations or protrusions near a proximal end of an internal channel of a straw.

13. The food delivery mouthpiece system of claim 11, wherein the cap engagement feature is disposed on the inner wall of the spout.

14. The food delivery mouthpiece system of claim 11, wherein the cap engagement feature and the lumen securement portion are configured to secure together via a snap fit, press fit, interference fit, or screwed engagement.

15. The food delivery mouthpiece system of claim 11, wherein the lumen securement portion extends distally through a straw and comprises a semi-flexible anchor.

16. A unitary food delivery mouthpiece configured for connection to an outer wall of a straw secured to and extending outwardly from a food container, the outer wall of the straw being outside of the food container, comprising:

a base comprising a proximal face, a distal face, and a passage wall defining a passage extending through the base; and a spout extending proximally from and unitarily coupled to the proximal face and having an aperture on a proximal end, the spout comprising an outer wall and an inner wall integral with the outer wall, the inner wall defining a lumen;

wherein the passage, the lumen, and the aperture are substantially equal in diameter and are connected such that a liquid or semi-solid food can flow from an attached container, through the passage, through the lumen, and out the aperture;

wherein a proximal portion of the outer wall is bulbous-shaped and made of a soft semi-flexible material to resemble the shape and feel of a nipple.

17. A food delivery system comprising, a unitary mouthpiece comprising a tubular spout having an outer surface of soft semi-flexible material and comprising an outer wall and an inner wall integral with the outer wall, the inner wall defining a lumen, the spout having an aperture on a proximal end, a base unitarily coupled to the spout and extending radially outward from the spout, the spout and base being configured to couple to an outer wall of a straw secured to and extending outwardly from a food pouch, the outer wall of the straw being outside of the food pouch and so that food can flow from the food pouch through the straw and mouthpiece with the base being configured to protect an individual's mouth from contact with edges of the food pouch that are adjacent the straw, the spout being configured for placement over the straw extending from the food pouch such that at least a portion of the inner wall of the mouthpiece abuts an outer wall of the straw and the proximal end of the spout extends beyond an end of the straw and with the outer surface of soft semi-flexible material covering the straw and protecting an individual's mouth from contact with the straw, and a squeezable pouch filled at least partially with a liquid or semi-solid food, wherein the squeezable pouch comprises one or more collapsible walls and a straw coupled to a proximal pouch end.

18. The food delivery system of claim 17, wherein the food delivery mouthpiece is removably coupled to the squeezable pouch via a snap fit, press fit, interference fit, or complementary threading.

19. The food delivery system of claim 18, wherein at least the passage wall of the food delivery mouthpiece is configured to engage with at least an outer surface of the straw.

20. The food delivery system of claim 18, wherein the food delivery mouthpiece further comprises an inner straw extension extending distally from the base and configured for insertion into an inner channel of the straw.

21. The food delivery system of claim 20, wherein the inner straw extension comprises an anchor at a distal end, the anchor extending radially beyond an inner perimeter of the straw.

22. The food delivery system of claim 20, wherein the inner straw extension comprises a series of openings.

23. The food delivery system of claim 17, wherein the food delivery mouthpiece is permanently affixed to the straw of the squeezable pouch.

24. The food delivery system of claim 23, further comprising a straw structure extending distally from the straw into an interior portion of the squeezable pouch, the straw structure having an inlet and an aperture configured to receive liquid or semi-solid food from inside the squeezable pouch.

25. The food delivery system of claim 24, wherein the straw structure extends at least halfway into the interior portion of the squeezable pouch.

26. The food delivery system of claim 24, wherein the straw structure has at least two apertures positioned along a wall of the straw structure.

* * * * *